United States Patent [19]

Szymski

[11] Patent Number: 4,712,790

[45] Date of Patent: Dec. 15, 1987

[54] CYCLE EXERCISER

[75] Inventor: Eugene J. Szymski, Skokie, Ill.

[73] Assignee: Schwinn Bicycle Company, Chicago, Ill.

[21] Appl. No.: 40,341

[22] Filed: Apr. 20, 1987

[51] Int. Cl.[4] ..... A63B 21/00; F16H 37/06; F16H 7/00

[52] U.S. Cl. ..... 272/73; 74/665 GE; 474/87

[58] Field of Search ..... 272/73, 72, 71; 280/224, 233; 74/665 GE; 474/86, 87, 88, 89; 128/25 R

[56] References Cited

U.S. PATENT DOCUMENTS

| | | | |
|---|---|---|---|
| 2,320,489 | 6/1943 | Turner et al. | 272/73 |
| 2,603,486 | 7/1952 | Hughes | 128/25 R |
| 3,578,800 | 5/1971 | DeNepi | 272/73 |
| 4,188,030 | 2/1980 | Hooper | 272/73 |
| 4,657,244 | 4/1987 | Ross | 272/73 |

FOREIGN PATENT DOCUMENTS

| | | | |
|---|---|---|---|
| 132504 | 5/1949 | Australia | 272/73 |
| 89009 | 4/1967 | France | 272/73 |
| 89347 | 6/1967 | France | 272/73 |
| 2003598 | 11/1969 | France | 272/73 |
| 2500311 | 8/1982 | France | 272/73 |
| 453982 | 8/1968 | Switzerland | 272/73 |
| 4221 | of 1901 | United Kingdom | 280/233 |

OTHER PUBLICATIONS

Schwinn "Air-Dyne" brochure published by Excelsior Fitness Equipment Co., Northbrook, Ill.

*Primary Examiner*—Richard J. Apley
*Assistant Examiner*—S. R. Crow
*Attorney, Agent, or Firm*—McCaleb, Lucas & Brugman

[57] ABSTRACT

A cycle exerciser has a pedal-actuatable drive shaft and a pair of counter shafts rotatably mounted about spaced, parallel axes. First and second sprockets are mounted on the drive shaft and on one of the counter shafts, respectively. Third and fourth sprockets are mounted on the other counter shaft. A fifth sprocket is connected to an energy-absorbing wheel. The first and second sprockets are the same size and larger than the third sprocket. The fourth sprocket is larger than the fifth. A pair of oscillatable handle bar levers are connected to drive crank arms at opposite ends of the one counter shaft. A primary endless chain is in wraparound connecting engagement with the first, second, and third sprockets. A secondary endless chain is in wraparound connecting engagement with the fourth and fith sprockets. Energy is applied to the wheel through foot pedals and/or the handle bar levers.

6 Claims, 3 Drawing Figures

CYCLE EXERCISER

BACKGROUND OF THE INVENTION

This invention relates to cycle exercisers and particularly to an ergometer-exerciser which works muscle groups in the arms, legs, and upper and lower torso, thereby placing a uniformly high demand on the blood and oxygen circulation systems throughout the entire body.

Cycle exercisers of this general type which inputs energy through pedals and/or handle bar levers are disclosed in Hooper U.S. Pat. No. 4,188,030 and Brilando U.S. Application Ser. No. 036,882 filed Apr. 10, 1987 which are licensed or assigned to the assignee of this invention.

SUMMARY OF THE INVENTION

It is a general object of the present invention to provide an improved cycle-type ergometer-exerciser capable of simultaneously working muscle groups in the arms, legs, and upper and lower torso while precisely measuring the work output.

According to the present invention, there is provided a cycle exerciser having a frame, a pedal-actuatable main drive shaft, a pair of counter shafts, and energy-absorbing means rotatably mounted thereon. A pair of handle bar levers are oscillatably mounted on the frame. A first sprocket is mounted on the main drive shaft. A second sprocket, the same size as the first sprocket is mounted on one of the counter shafts. A pair of drive crank arms are secured to opposite ends of the one counter shaft and extend in opposite lateral directions. Third and fourth sprockets are mounted on the other countershaft. A fifth sprocket is in driving relation with the energy absorbing means. A primary orbitally moveable endless chain is in wraparound connecting engagement with the first, second, and third sprockets. A secondary orbitally moveable endless chain is in wraparound connecting engagement with the fourth and fifth sprockets. The handle bar levers are connected to the drive cranks arms enabling the energy-absorbing means to be rotatably driven by the pedals and handle bar levers jointly.

More particularly, the main drive shaft and the two counter shafts are mounted for rotation about separate, spaced, parallel, substantially horizontal axes.

Among other specific features of the invention, each of the first and second sprockets is larger than the third sprocket to enable rotation of said other counter shaft at a higher speed than the main drive shaft. The fourth sprocket is larger than the fifth sprocket to enable the energy-absorbing means to run faster than said other counter shaft. The first, second, and third sprockets which are interconnected by the primary chain are in the same substantially vertical plane on one side of the frame. The fourth and fifth sprockets which are interconnected by the secondary chain are in the same substantially vertical plane on the other side of the frame.

BRIEF DESCRIPTION OF THE DRAWINGS

Other objects and advantages will be apparent from the following description taken in connection with the accompanying drawings in which.

Like parts are referred to by like reference characters.

DESCRIPTION OF THE PREFERRED EMBODIMENTS

Figure 1:
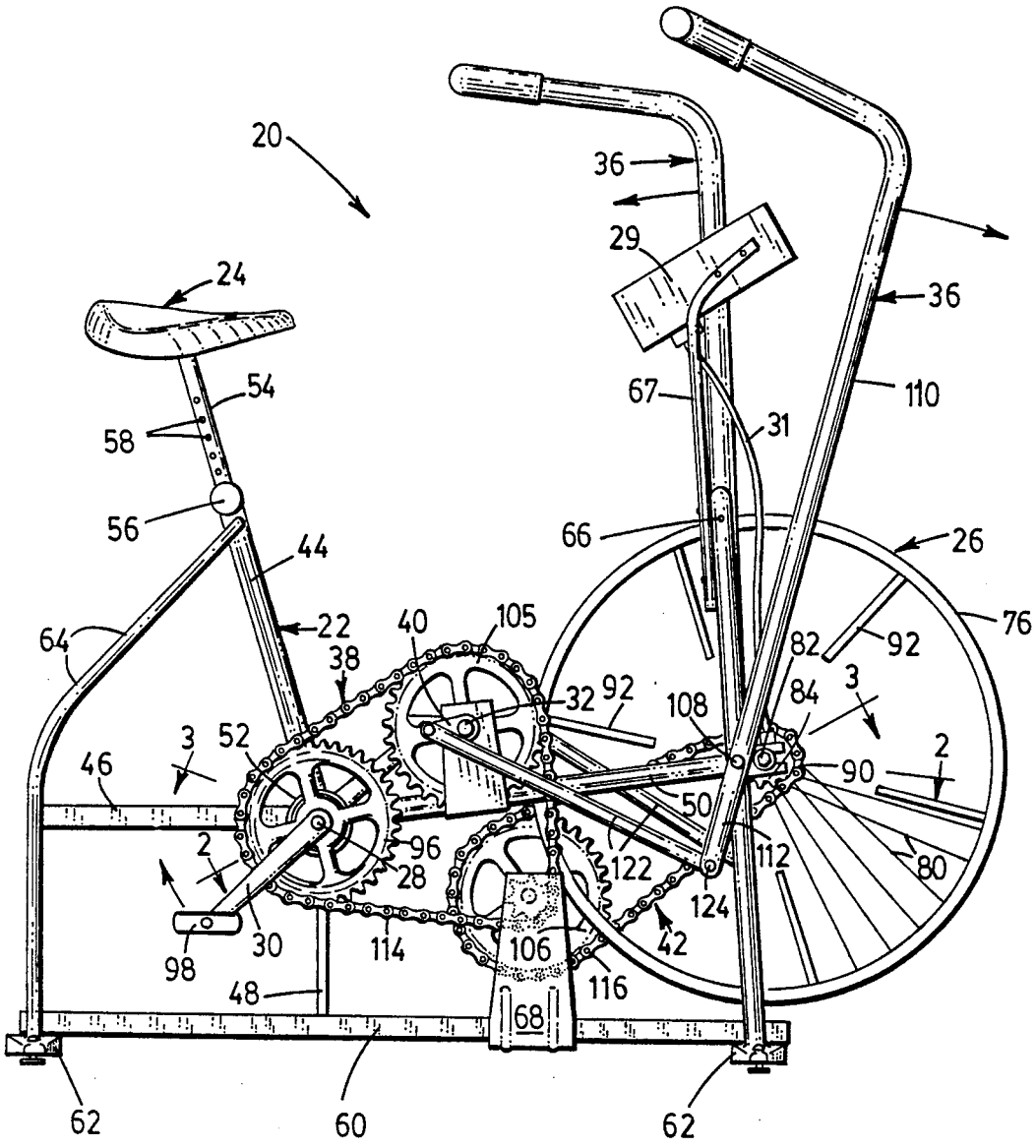
FIG. 1 is a right side elevational view of a cycle exerciser illustrating one form of the present invention.
Figure 2:
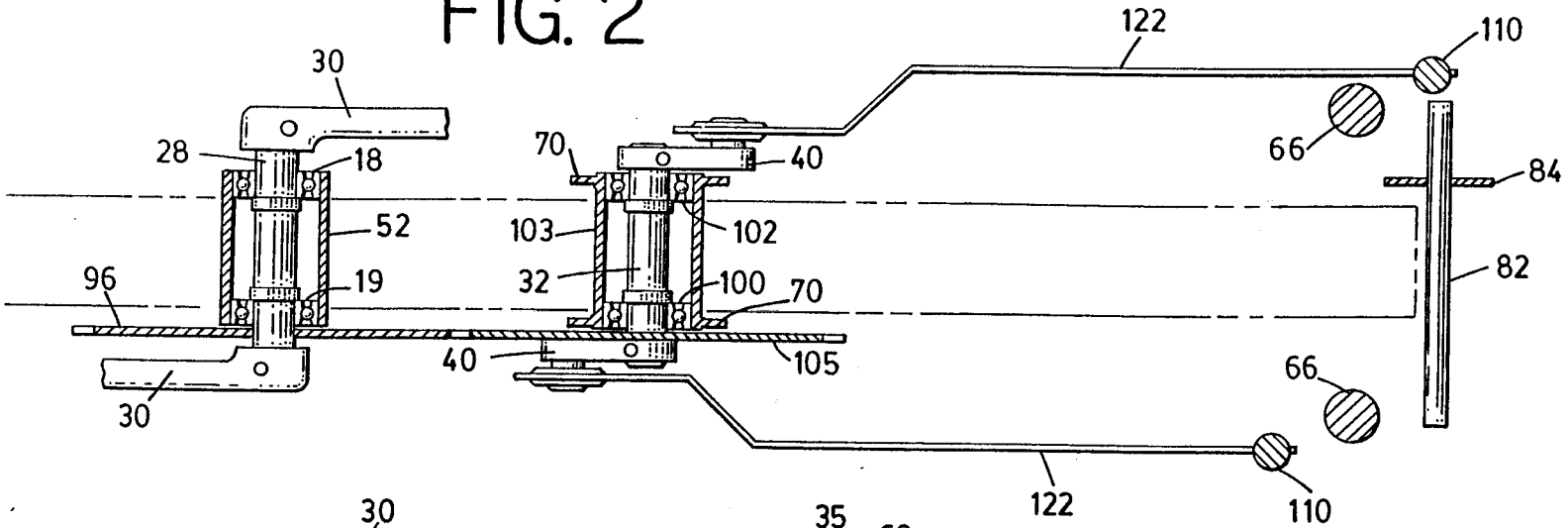
FIG. 2 is a fragmentary enlarged sectional view of FIG. 1 taken along line 2—2.
Figure 3:
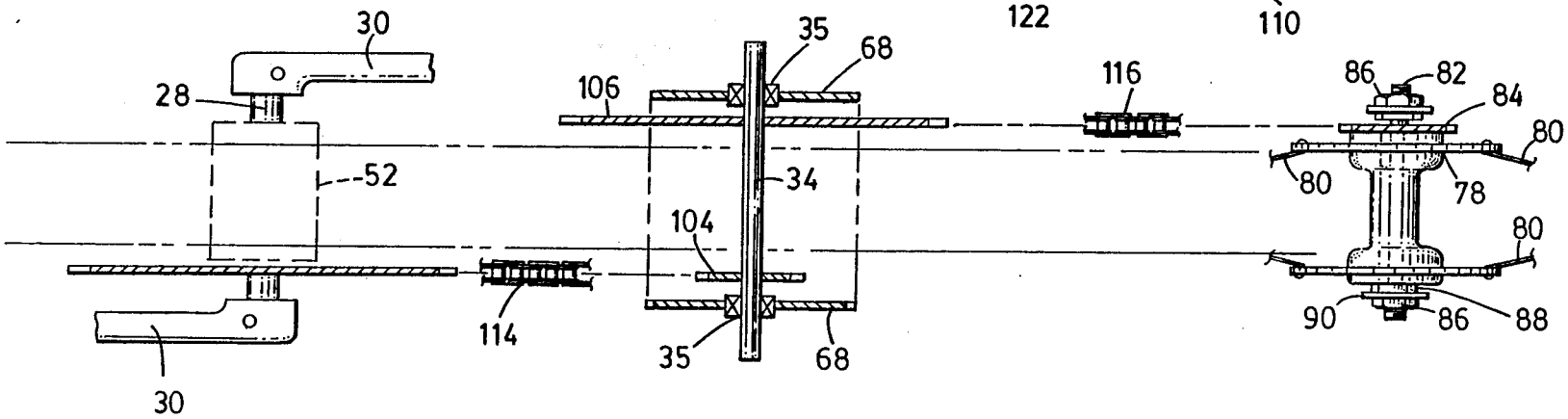
FIG. 3 is a fragmentary sectional view of FIG. 1 taken along line 3—3.

Referring now to the specific embodiment of the invention shown in the drawings, the cycle exerciser is generally designated 20. It has a frame 22; a seat 24 mounted on the frame; energy-absorbing means 26 rotatably mounted on the frame; a horizontal main drive shaft 28; foot pedal crank arms 30,30 at opposite ends of the main drive shaft; a pair of counter shafts 32,34; two handle bar levers 36,36 mounted on the frame for oscillating movement; first drive means 38 connecting the main drive shaft 28 to the energy-absorbing means 26; a pair of drive crank arms 40,40 secured to opposite ends of counter shaft 32 and extending laterally therefrom in opposite directions; and second drive means 42 connecting the handle bar levers 36,36 to the drive crank arms 40,40 to cause rotation of the energy absorbing means in response to oscillating movement of the handle bar levers. A workload indicator 29 is connected to the energy absorbing means 26 through a cable 31.

The frame 22 comprises a seat tube 44; a rear bracket 46; a downward strut 48; and a generally horizontal fork 50, all secured to and extending radially outwardly from a crank shaft journal or bottom bracket 52. A saddle post 54 is telescopically slidably fitted in the seat tube 44 and the seat 24 is held at a selected height by engagement of an adjustment knob assembly 56 with a selected one of openings 58 in the seat post. There is a longitudinally extending channel-type base member 60 with adjustable foot members, 62,62. A pair of rearwardly and downwardly extending seat stays 64,64 are secured to the seat tube 44, rear bracket 46, and rear end of the base member 60. At its forward end, the frame 22 has an arched yoke 66 formed of tubing with its mid portions secured to the forward ends of the horizontal fork 50, and its lower ends secured to the front end of the base member 60. The workload indicator 29 is supported on the yoke 66 by a pair of upstanding curved rods 67. Two upstanding gudgeon plates are similarly supported on the base member 60. Two gudgeon plates 70,70 are similarly supported on the rear end portion of the 50.

The energy-absorbing means 26 is here illustrated schematically as a wheel having a rim 76 connected to a hub 78 by spokes 80. The wheel is rotatably journaled about a stationary axle 82 which is supported at the front end of the frame. A chain sprocket 84 is fastened to the hub 78 for rotation with the wheel. Resistance to wheel rotation in the present case is achieved through air scoops or blades 92 secured within the rim. Other means such as friction brake pads engageable with the wheel rim may be used.

The main drive shaft 28 may be rotatably journaled by conventional bicycle-type bearings 18,19 within the bottom bracket 52. A first sprocket 96 is fastened to the main drive shaft 28 for rotation therewith. The foot pedal crank arms 30,30 are fastened in any suitable manner to the ends of the shaft and bicycle-type pedals 98 are pivotally mounted to their outer ends.

The counter shaft 32 is rotatably journaled in bearings 100,102 carried in a housing 103 supported between the two gudgeon plates 70,70. A second chain sprocket 105, the same size as sprocket 96 is fastened to one end of counter shaft 32 for rotation therewith.

Each of the handle bar levers 36,36 are pivotally connected to the frame about a pivot axis at 108. Each handle bar lever is generally upright and is pivoted so there is a relatively long portion 110 above the axis and a relatively short portion 112 below it.

The other counter shaft 34 is rotatably journaled in gudgeon plates 68,68, within bearings 35,35. Third and fourth sprockets 104 and 106 respectively are mounted on opposite ends of counter shaft 34.

In the embodiment shown, the first sprocket 96, second sprocket 105, and fourth sprocket 106 are all the same, relatively large size for manufacturing economy and stocking convenience. The third sprocket 104 and fifth sprocket 84 are substantially smaller and both are the same size for the same reasons. Sprockets 96, 104 and 105 are in the same vertical plane on the right side of the frame. Sprockets 84 and 106 are in the same vertical plane on the left side of the frame.

Referring now to the first drive means generally designated 38 which connects the main drive shaft 28 to the energy-absorbing wheel 26 through counter shafts 32 and 34, this means includes a primary orbitally moveable endless chain 114 in wraparound connecting engagement with the three sprockets 96, 105, and 104 respectively. A secondary orbitally moveable endless chain 116 is in wraparound connecting engagement with sprockets 106 and 84. Because of the above described size differential between the sprockets, the wheel 26 is rotated at a substantially higher speed than the pedal drive shaft 28.

It should be understood that instead of the chains and sprockets specifically illustrated, other endless, orbitally moveable, flexible drive means may be used, for example, V-, flat-, or notched-belting with appropriate pulleys substituted for the sprockets.

The second drive means generally designated 42 enables the handle bar levers 36,36 to rotate the energy-absorbing wheel through counter shafts 32 and 34. This second drive means includes a pair of drive links or bars 122 having pivotal connections at 124,124 through corresponding ends of drive crank arms 40 and handle bar levers 36. This second drive means also includes sprockets 105 and 104 interconnected by primary chain 114, counter shaft 34, and sprockets 106 and 84 interconnected by secondary chain 116, all as described above.

It is preferred for most efficient upper and lower body exercising that the legs and arms move at the same pace, as in normal walking or running. For this purpose, sprockets 96 and 105 are the same size so the main drive shaft 28 and counter shaft 32 will rotate at the same speed. The relative angular positions of the pedal crank arms 30 and drive crank arms 40 may be set to coordinate pedal and handle bar movements in any preferred way. For example, the handle bar levers 36,36 may move with, or opposite to, pedal movement, as desired.

As one specific example, the large sprockets 96, 105, and 106 may be about 3.29 times larger than the small sprockets 84 and 104. For each revolution of the main pedal shaft 28, this would provide one revolution of counter shaft 32, 3.29 revolutions of counter shaft 34 and 10.8 revolutions of the energy-absorbing wheel 26. The invention is not limited to this particular set of chain and sprocket sizes or ratios.

Use and operation are believed obvious in view of the above description. The main pedal drive shaft 28 drives the wheel 26 through sprockets 96, 105, 104, 106, and 84, and chains 114 and 116. The handle bar levers 110 connect into the aforesaid drive train at the ends of the drive crank arms 40 and rotate the wheel 26 through sprockets 105, 104, 106, and 84, and chains 114 and 116 while the first sprocket 96 idles at the same pace as sprocket 105.

Three modes are available for driving the wheel 26. In the first mode, it can be driven by the crank pedals 30 alone. In a second mode, it can be driven by the handle bar levers 36 alone. In a third, combination mode, it can be driven by simultaneous operation by both the pedal crank arms and handle bar levers.

The embodiment described and shown to illustrate the present invention has been necessarily specific for purposes of illustration. Alterations, extension, and modifications would be apparent to those skilled in the art. The aim of the appended claims, therefore, is to cover all variations included within the spirit and scope of the invention.

The embodiments of the invention is which an exclusive property or privilege is claimed or defined as follows:

1. In a cycle exerciser having a frame, a pedal-actuatable main drive shaft, a pair of counter shafts, and energy-absorbing means all rotatably mounted thereon, and a pair of handle bar levers oscillatably mounted thereon, the improvement wherein said shafts are mounted about separate, spaced, parallel, substantially horizontal axes;

a first sprocket is mounted on said main drive shaft;

a second sprocket the same size as said first sprocket is mounted on one of said counter shafts; a pair of drive crank means are secured to opposite ends of said one counter shaft and extended in opposite lateral directions;

third and fourth sprockets are mounted on the other counter shaft;

a fifth sprocket is in driving relation with said energy absorbing means;

a primary orbitally moveable endless chain is in wraparound connecting engagement with said first, second, and third sprockets; a secondary orbitally moveable endless chain is in wraparound connecting engagement with said fourth and fifth sprockets; and said handle bar levers are connected to said drive crank arms;

whereby said energy-absorbing means may be rotatably driven by said pedals and said handle bar levers jointly or separately.

2. In a cycle exerciser, the improvement of claim 1 in which said first sprocket is larger than said third sprocket to rotate said other counter shaft faster than said main drive shaft.

3. In a cycle exerciser, the improvement of claim 1 in which said fourth sprocket is larger than said fifth sprocket to rotate said energy-absorbing means faster than said other counter shaft.

4. In a cycle exerciser, the improvement of claim 1 in which said first, second, and third sprockets are in the same substantially vertical plane.

5. In a cycle exerciser, the improvement of claim 1 in which said fourth and fifth sprockets are in the same substantially vertical plane.

6. In a cycle exerciser, the improvements of claims 4 and 5 in which said first, second, and third sprockets are on one side of the frame, and said fourth and fifth sprockets are on the opposite side of the frame.

* * * * *

UNITED STATES PATENT AND TRADEMARK OFFICE

CERTIFICATE OF CORRECTION

PATENT NO. : 4,712,790

DATED : December 15, 1987

INVENTOR(S) : Eugene J. Szymski

It is certified that error appears in the above—identified patent and that said Letters Patent is hereby corrected as shown below:

Col. 1, line 44, after "by the pedals" the sentence should continue to read "alone, the handle bar levers alone, or the pedals".

Col 4, line 41, "a secondary" should start a new paragraph.

Signed and Sealed this

Thirteenth Day of September, 1988

*Attest:*

DONALD J. QUIGG

*Attesting Officer*

*Commissioner of Patents and Trademarks*